US008118095B2

(12) United States Patent
Sarathi et al.

(10) Patent No.: US 8,118,095 B2
(45) Date of Patent: Feb. 21, 2012

(54) IN SITU COMBUSTION PROCESSES AND CONFIGURATIONS USING INJECTION AND PRODUCTION WELLS

(75) Inventors: Partha S. Sarathi, Bartlesville, OK (US); Wayne Reid Dreher, Jr., Katy, TX (US); Thomas J. Wheeler, Houston, TX (US); Wendell P. Menard, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 177 days.

(21) Appl. No.: 12/707,515

(22) Filed: Feb. 17, 2010

(65) Prior Publication Data

US 2010/0206563 A1 Aug. 19, 2010

Related U.S. Application Data

(60) Provisional application No. 61/153,894, filed on Feb. 19, 2009.

(51) Int. Cl.
*E21B 43/243* (2006.01)

(52) U.S. Cl. ..... 166/260; 166/256; 166/272.1; 166/302

(58) Field of Classification Search ..... None
See application file for complete search history.

(56) References Cited

U.S. PATENT DOCUMENTS

| | | | |
|---|---|---|---|
| 3,116,792 | A | 1/1964 | Purre |
| 3,369,604 | A | 2/1968 | Black et al. |
| 3,946,809 | A | 3/1976 | Hagedorn |
| 3,978,920 | A | 9/1976 | Bandyopadhyay et al. |
| 4,726,759 | A | 2/1988 | Wegener |
| 4,860,827 | A | 8/1989 | Lee et al. |
| 4,926,941 | A | 5/1990 | Glandt et al. |
| 4,993,490 | A | 2/1991 | Stephens et al. |
| 5,055,030 | A | 10/1991 | Schirmer |
| 5,211,230 | A | 5/1993 | Ostapovich et al. |
| 5,339,897 | A | 8/1994 | Leaute |
| 5,456,315 | A | 10/1995 | Kisman et al. |
| 5,626,191 | A | 5/1997 | Greaves et al. |
| 6,412,557 | B1 | 7/2002 | Ayasse et al. |
| 6,631,761 | B2 | 10/2003 | Yuan et al. |
| 6,918,444 | B2 | 7/2005 | Passey et al. |
| 6,951,247 | B2 | 10/2005 | de Rouffignac et al. |
| 2005/0082057 | A1 | 4/2005 | Newton et al. |
| 2008/0169096 | A1 | 7/2008 | Ayasse |

*Primary Examiner* — Zakiya W Bates

(57) ABSTRACT

Methods and systems relate to in situ combustion utilizing configurations of injection and production wells to facilitate the in situ combustion. The wells define vertically deviated lengths that have different orientations from one another. Further, heating processes such as resistive heating and cyclic steam stimulation may take place in one or both of the injection and production wells to precondition a reservoir prior to the in situ combustion.

16 Claims, 3 Drawing Sheets

IN SITU COMBUSTION PROCESSES AND CONFIGURATIONS USING INJECTION AND PRODUCTION WELLS

CROSS-REFERENCE TO RELATED APPLICATIONS

None

STATEMENT REGARDING FEDERALLY SPONSORED RESEARCH OR DEVELOPMENT

None

FIELD OF THE INVENTION

Embodiments of the invention relate to methods and systems for oil recovery with in situ combustion.

BACKGROUND OF THE INVENTION

In situ combustion offers one approach for recovering oil from reservoirs in certain geologic formations. With in situ combustion, an oxidant injected through an injection well into the reservoir reacts with some of the oil to propagate a combustion front through the reservoir. This process heats the oil ahead of the combustion front. Further, the injection gas and combustion gasses drive the oil that is heated toward an adjacent production well.

Success of the in situ combustion in a heavy oil or bitumen environment depends on stability of the combustion front and ability to ensure that oxidation occurring is an exothermic reaction. Amount of beneficial thermal cracking of the oil to make the oil lighter tends to increase with higher temperatures from the oxidation. Further, oxidation of the oil by an endothermic reaction can create hydrogen bonding and result in undesired increases in viscosity of the oil.

Various factors attributed to failure of the in situ combustion include loss of ignition, lack of control, and inadequate reservoir characterization. For maximum recovery of the oil, the combustion front must be able to stay ignited in order to sweep across the entire reservoir. Due to issues such as formation heterogeneity influencing the combustion front, prior approaches often result in instability of the combustion front, premature extinguishing of the combustion front, or inability to achieve or maintain desired temperatures.

Therefore, a need exists for improved methods and systems for oil recovery with in situ combustion.

SUMMARY OF THE INVENTION

In one embodiment, a method of conducting in situ combustion includes forming an injection well that extends in length deviated from vertical in at least a first direction and at two locations having a vertical offset from each other. The method further includes forming a plurality of production wells that each extend in length deviated from vertical with orientation misaligned relative to the first direction and at least one of the production wells deviated from vertical in a second direction. Injecting oxidant into the injection well to propagate combustion enables recovering hydrocarbons through the production wells.

According to one embodiment, a method of conducting in situ combustion includes forming an injection well that extends in length deviated from vertical and forming a production well that extends in length deviated from vertical toward the injection well. Heating a reservoir surrounding the injection well along a section of the injection well where vertically deviated occurs without igniting oil in the reservoir and with operations conducted through the injection well. Further, the method includes initiating the in situ combustion after heating the reservoir and recovering hydrocarbons through the production well. The initiating includes injecting oxidant into the injection well and may be achieved spontaneously or by using an ignition device.

For one embodiment, a method of conducting in situ combustion includes injecting oxidant into an injection well to propagate combustion and recovering hydrocarbons through a plurality of production wells. The production wells define heels at where the production wells turns toward horizontal and toes at where the production wells terminates distal to the heels. The injecting oxidant occurs along longitudinal sections of the injection well that are closer to the toes of the production wells than the heels of the production wells, are spaced from one another closer to surface than the toes of the production wells, and come closest to the production wells intermediately along the longitudinal sections.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to in situ combustion. Configurations of injection and production wells facilitate the in situ combustion. The wells define vertically deviated lengths that have different orientations from one another. Further, heating processes such as resistive heating and cyclic steam stimulation may take place in one or both of the injection and production wells to precondition a reservoir prior to the in situ combustion.

Figure 1:
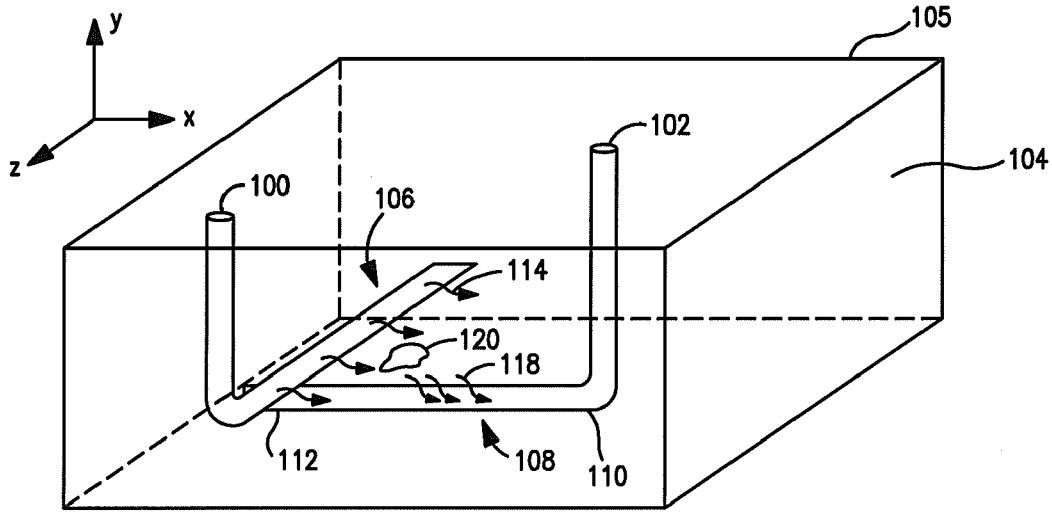
FIG. 1 is a three dimensional schematic of injection and production wells in a formation, according to one embodiment of the invention.
Figure 2:
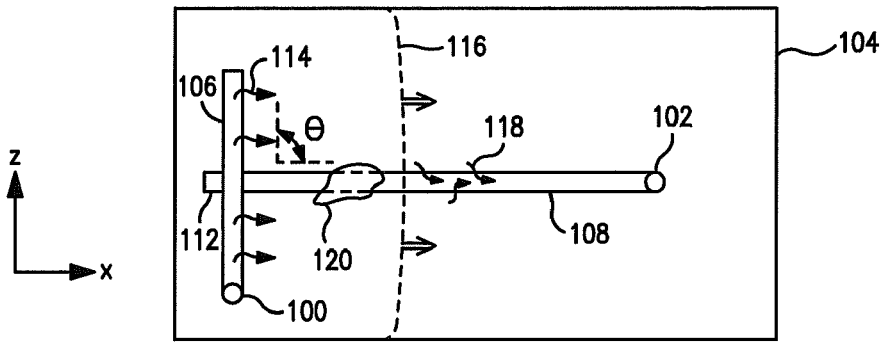
FIG. 2 is a schematic top view of the injection and production wells shown in FIG. 1, according to one embodiment of the invention.

FIGS. 1 and 2 illustrate an injection well 100 and a production well 102 disposed in a formation 104. Vertical from a surface 105 of earth is represented in a "y" direction with "x" and "z" directions being orthogonal to each other and the y-direction. For some embodiments, the injection well 100 includes a horizontal injector portion 106 that may extend lengthwise in the z-direction. Further, the production well 102 may include a horizontal producer portion 108 that may extend lengthwise in the x-direction.

Direction of deviation from vertical for the horizontal injector portion 106 relative to direction of deviation from vertical for the horizontal producer portion 108 defines an angle θ. While the angle θ is shown to be about 90°, the angle may be between 20° and 160°, such as between 80° and 100°. For example, the horizontal producer portion 108 may extend in the x-direction while the horizontal injector portion 106 may extend in orientation midway between the x-direction and the z-direction creating the angle θ of 45°.

Further, angle of deviation from the y-direction for the horizontal injector portion 106 and/or the horizontal producer portion 108 may be between 20° and 160°, between 80° and 100°, or about 90°. The angle of deviation from the y-direction defines slant toward horizontal corresponding to 90°. In comparison to exemplary less horizontally oriented slanting shown in FIGS. 3 and 4, both the horizontal injector portion 106 and the horizontal producer portion 108 deviate from the y-direction by about 90°.

The production well 102 defines a heel 110 at where the production well 102 turns toward horizontal and a toe 112 at where the horizontal producer portion 108 terminates distal to the heel 110. In some embodiments, the horizontal injector portion 106 is closer to the toe 112 of the production well 102 than the heel 110 of the production well 102. In operation, oxidant 114 injected into the formation 104 along the horizontal injector portion 106 propagates a combustion front 116 from the toe 112 of the production well 102 to the heel 110 of the production well 102. Examples of the oxidant 106 include oxygen or oxygen-containing gas mixtures. Injection of the oxidant occurs at multiple spaced locations or continuous along the horizontal injector portion 106.

For some embodiments, the horizontal injector portion 106 is closer to the surface 105 than the toe 112 of the production well 102. The toe 112 of the production well 102 may terminate prior to reaching beneath the horizontal injector portion 106 or may extend beneath the horizontal injector portion 106 such that the horizontal injector portion 106 and the horizontal producer portion 108 cross one another, spaced one on top of another. As the combustion front 116 progresses through the formation 104, combustion gasses (e.g., $CO_2$ and CO) and hydrocarbons 118 warmed by the in situ combustion drain downward by gravity into the horizontal producer portion 108 and are recovered via the production well 102.

In some embodiments, the injection well 100 comes closest to the production well 102 intermediately along the horizontal injector portion 106 and may come within 5 to 30 meters of the production well 102. Fluid communication exists between the horizontal injector portion 106 and the toe 112 of the production well 102 upon initiating the in situ combustion. Spacing between the horizontal injector portion 106 and the toe 112 of the production well 102 enables this communication that is necessary for the in situ combustion to progress through the formation 104. Further, the horizontal injector portion 106 increases potential area for the communication relative to utilizing only vertical injection wells where lateral area for establishing communication is limited.

Location of entry for the hydrocarbons 118 into the horizontal producer portion 108 changes along the horizontal producer portion 108 as the combustion front 116 moves through the formation 104. After the combustion front 116 passes over part of the horizontal producer portion 108, oil no longer flows into the part of the horizontal producer portion 108 that is disposed behind the combustion front and in clean sands devoid of oil. Inflow of the hydrocarbons 118 ahead of the combustion front 116 toward the heel 110 of the production well 102 is limited to a region of mobile oil caused by the in situ combustion.

Pressure from the injection and the combustion gasses act to drive the mobile oil down toward the horizontal producer portion 108. Existence of differential pressures from the injection and the combustion gasses relative to inside the production well 102 augments gravity drainage into the production well 102. The horizontal injector portion 106 and the horizontal producer portion 108 orientation relative to one another ensures that the combustion front 116 remains stable and allows draining of the hydrocarbons 118 into the production well 102 without significant bypassing of the mobile oil below the production well 102.

With the horizontal injector portion 106, injection is not limited to any finite reservoir thickness in the formation 104 since areal coverage can extend laterally. Lateral extent of the areal coverage creates the pressure gradient discussed herein across the combustion front 116 without loss of the gradient along the z-direction of the combustion front 116. Quantity of the oxidant 114 able to be injected into the formation 104 corresponds to available outlets into the formation that due to the horizontal injector portion 106 are also not limited by any finite reservoir thickness. The horizontal injector portion 106 thereby permits sufficient rate of oxidant injection into the formation 104 to result in high temperature oxidation or exothermic reactions during the in situ combustion. Given that increase in oxidant supply tends to raise temperatures for the in situ combustion, the rate of oxidant injection possible through the horizontal injector portion 106 thus also enables thermally upgrading the mobile oil while in the formation 104 to lighter oil.

Further, the areal coverage provided by the horizontal injector portion 106 ensures sweep efficiency for the combustion front 116 across the formation 104. Heterogeneities in the formation 104 such as an impermeable body 120 can result in gas channeling or otherwise influence transmission of the oxidant 114 through the formation 104. Any composition of relatively lower porosity within the formation 104 may provide the impermeable body 120. The horizontal injector portion 106 provides the oxidant 114 on multiple sides of the impermeable body 120 that could otherwise inhibit the oxidant reaching the combustion front 116 beyond one of the sides of the impermeable body 120. In this manner, the horizontal injector portion 106 mitigates change to the combustion front 116 due to the impermeable body 120.

Figure 3:
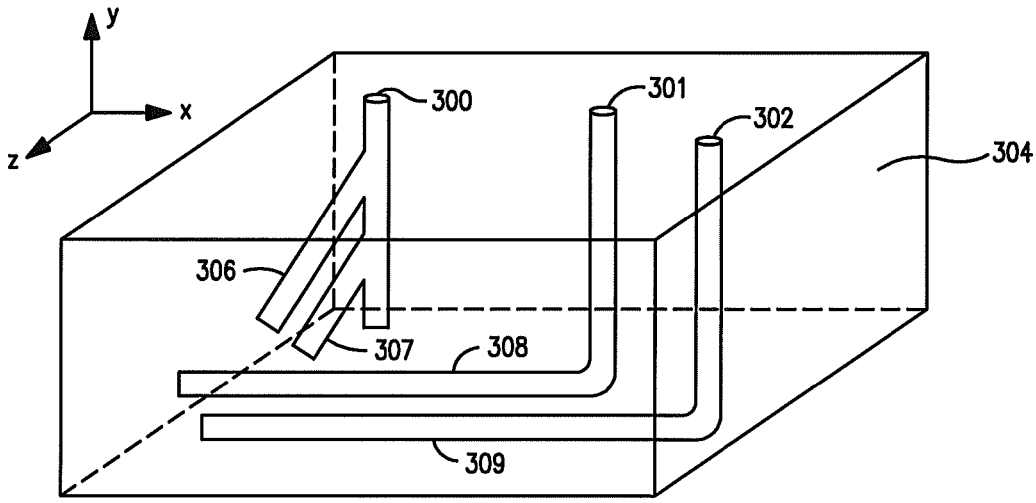
FIG. 3 is a three dimensional schematic of a multilateral injection well and dual production wells in a formation, according to one embodiment of the invention.
Figure 4:
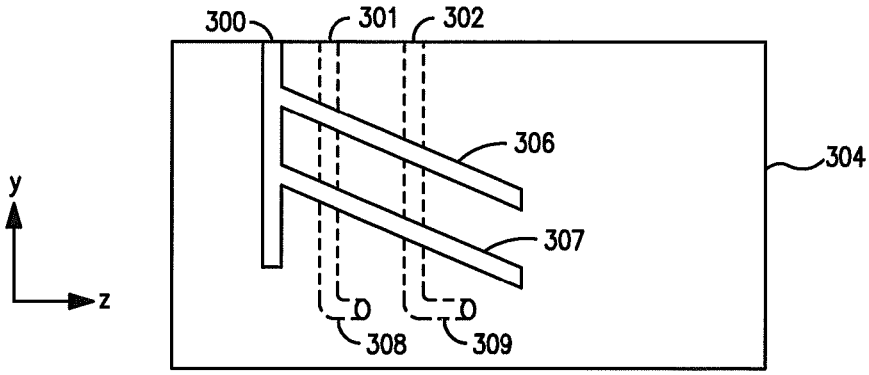
FIG. 4 is a schematic sectional side view of the injection and production wells shown in FIG. 3, according to one embodiment of the invention.

FIGS. 3 and 4 show a multilateral injection well 300 and first and second production wells 301, 302 in a formation 304. Configurations illustrated for the wells 300, 301, 302 exemplify suitable variations of foregoing described aspects. Selection of appropriate variations depends on reservoir particulars, such as size and shape, within the formation 304. The injection well 300 defines a first lateral wellbore 306 and a second lateral wellbore 307. The first and second production wells 301, 302 have respective first and second horizontal portions 308, 309 deviated about 90° from vertical. Drilling techniques employed to create any of the wells 300, 301, 302 can create fish-bone patterns, multilaterals, slant wells, or horizontal wells deviated about 90° from vertical.

The first and second production wells 301, 302 both recover hydrocarbons during the in situ combustion generated by oxidant injection through the injection well 300. Some embodiments include additional production wells and/or injection wells. Regardless of a production well to injection well ratio, at least one production and injection well pair defines a configuration as set forth herein.

Referring to FIG. 4, the deviation from vertical (the y-direction) for the first and second lateral wellbores 306, 307 is less than 90°. The lateral wellbores 306, 307 thus slant downward while extending lengthwise in the z-direction. The first lateral wellbore 306 permits injecting into the formation 304 above the second lateral wellbore 307. Relative to using the second lateral wellbore 307 alone, the first lateral wellbore 306 increases areal coverage in the y-direction in addition to the z-direction and also increases surface area available for injection.

Further, the first and second horizontal portions 308, 309 extend lengthwise in an offset direction from the x-direction. With reference to the angle θ shown in FIG. 2, misalignment between the offset direction, in which the production wells 301, 302 extend in length deviated from vertical, and the z-direction, in which the injection well 300 extends lengthwise deviated from vertical, defines an angle of less than 90°.

Figure 5:
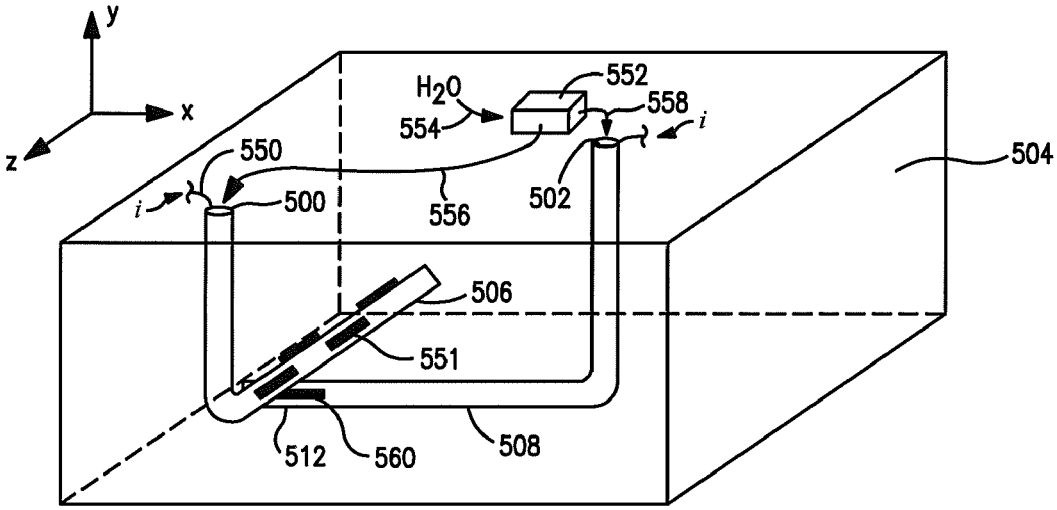
FIG. 5 is a three dimensional schematic of heated horizontal injection and production wells in a formation, according to one embodiment of the invention.

FIG. 5 shows a heated horizontal injection well 500 and a heated horizontal production well 502 in a formation 504. Only one of the injection well 500 or the production well 502 may be heated for some embodiments. Further, the heated horizontal injection well 500 and/or the heated horizontal production well 502 provide exemplary heating of the formation 504 prior to conducting the in situ combustion as may occur with any embodiments described herein.

Start-up represents a potential problem for the in situ combustion since inefficient ignition processes due to lack of adequate initial communication between the injection well 500 and the production well 502 can promote endothermic reactions instead of the exothermic reactions. When cold, bitumen in the formation 504 tends to block the communication between the injection well 500 and the production well 502. Heating the formation 504 around a vertically deviated section 506 of the injection well 500 and/or a vertically deviated section 508 of the production well 502 reduces viscosity of the bitumen and makes the bitumen mobile.

This reduction in viscosity results in decrease of initial oil saturation around the injection well 500. In addition, the reduction in viscosity allows for the combustion gasses and the mobile oil to be produced through the production well 502. Heating the deviated sections 506, 508 of the wells 500, 502 enables heating of a lateral portion of the formation 504. Ability to heat the lateral potion of the formation increases heating efficiency and increases areal extent of the bitumen capable of being heated to establish communication as desired. Since the communication depends on proximity of the injection well 500 to the production well 502, the heating further permits greater separation of the injection well 500 from the production well 502.

In some embodiments, a conductive element 550 conveys current (i) to resistive heating elements 551 disposed along the vertically deviated section 506 of the injection well 500. The heating elements 551 heat the formation 504 by thermal conduction. Heating of the formation with the resistive heating elements 551 may take place over an extended period of time, such as at least 100 days or at least 300 days.

Cyclic steam stimulation provides another option for heating the reservoir 504 surrounding the vertically deviated section 506 of the injection well 500. While both the steam stimulation and the heating with the elements 551 are depicted, one or both such techniques may be utilized prior to the in situ combustion. For the steam stimulation, a steam generator 552 converts a water input 554 into steam. An injector output 556 from the steam generator 552 directs the steam through the injection well 500 into the formation 504, where the steam is held in place to allow for heat of the steam to transfer into the cold bitumen. Once this initial heat transfer takes place, additional steam is injected into the injection well 500. This process of injecting steam is repeated as necessary to heat the formation around the vertically deviated section 506 of the injection well 500.

Similar to the injection well 500, heating of the vertically deviated section 508 of the production well 502 may utilize resistive based elements 560 and/or the cyclic steam stimulation. The resistive based elements 560 may be disposed only proximate a toe 512 of the production well 502 where possible to heat the bitumen between the injection well 500 and the production well 502. A producer output 558 of the steam generator 552 may repeatedly introduce steam pulses into the production well 502 for preheating the formation 504 prior to performing the in situ combustion.

For some embodiments, the in situ combustion described herein may take place after processes for steam assisted gravity drainage (SAGD). For example, injecting steam into the injection well 100 shown in FIG. 1 may heat and drive oil into the production well 102 where the oil is recovered. Once recovery of the oil using this steam injection diminishes beyond economical returns, the in situ combustion commences as a follow-up recovery operation.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method of conducting in situ combustion, comprising:

forming an injection well that extends in length deviated from vertical in at least a first direction and at two locations having a vertical offset from each other;

forming a plurality of production wells that each extend in length deviated from vertical with orientation misaligned relative to the first direction, wherein at least one of the production wells is deviated from vertical in a second direction;

injecting oxidant into the injection well to propagate combustion; and recovering hydrocarbons through the production wells.

2. The method according to claim 1, wherein the first direction is misaligned relative to the second direction by an angle that is between 20° and 160°.

3. The method according to claim 1, wherein the first direction is misaligned relative to the second direction by an angle that is about 90°.

4. The method according to claim 3, wherein the injection and production wells are each deviated from vertical by about 90°.

5. The method according to claim 1, wherein the injection and production wells are each deviated from vertical by between 80° and 90°.

6. The method according to claim 1, further comprising heating a reservoir surrounding the injection well along a vertically deviated section of the injection well, wherein the heating occurs without igniting oil in the reservoir and with operations conducted through the injection well.

7. The method according to claim 1, further comprising injecting steam into a reservoir surrounding the injection well along a vertically deviated section of the injection well prior to igniting oil in the reservoir.

8. The method according to claim 1, further comprising heating a reservoir surrounding the injection well along a vertically deviated section of the injection well with a resistive heating element.

9. The method according to claim 1, further comprising introducing heat to an area surrounding at least one of the production wells with operations conducted through the at least one of the production wells.

10. The method according to claim 1, further comprising heating a reservoir surrounding the injection and production wells along vertically deviated sections of the production and injection wells, wherein the heating occurs without igniting oil in the reservoir and with operations conducted through the injection and production wells.

11. The method according to claim 1, wherein the injecting oxidant occurs along a longitudinal section of the injection well and the longitudinal section is closer to toes of the production wells than heels of the production wells, is closer to surface than the toes of the production wells, and comes closest to the production wells intermediately along the longitudinal section.

12. A method of conducting in situ combustion, comprising:

forming an injection well that extends in length deviated from vertical;

forming a production well that extends in length deviated from vertical toward the injection well;

heating a reservoir surrounding the injection well along a section of the injection well where vertically deviated, wherein the heating occurs without igniting oil in the reservoir and with operations conducted through the injection well;

initiating the in situ combustion after heating the reservoir, wherein the initiating includes injecting oxidant into the injection well; and recovering hydrocarbons through the production well.

13. The method according to claim 12, wherein the injection and production wells deviate from vertical in respective first and second directions misaligned relative to one another.

14. The method according to claim 12, wherein the injection and production wells deviate from vertical between 80° and 90° and in respective first and second directions misaligned between 80° and 90° relative to one another.

15. The method according to claim 12, further comprising introducing heat to an area surrounding the production well with operations conducted through the production well.

16. The method according to claim 12, further comprising introducing heat to an area surrounding the production well with operations conducted through the production well, wherein the injection and production wells deviate from vertical in respective first and second directions misaligned relative to one another.

* * * * *